US008721102B2

(12) United States Patent
Lei et al.

(10) Patent No.: US 8,721,102 B2
(45) Date of Patent: May 13, 2014

(54) BACKLIGHT LAMP GUIDE, BACK COVER AND BACKLIGHT

(75) Inventors: Sijun Lei, Beijing (CN); Zhanchang Bu, Beijing (CN)

(73) Assignee: Beijing Boe Optoelectronics Technology Co., Ltd., Beijing (CN)

( * ) Notice: Subject to any disclaimer, the term of this patent is extended or adjusted under 35 U.S.C. 154(b) by 235 days.

(21) Appl. No.: 13/228,848

(22) Filed: Sep. 9, 2011

(65) Prior Publication Data

US 2012/0063119 A1 Mar. 15, 2012

(30) Foreign Application Priority Data

Sep. 10, 2010 (CN) ..... 2010 2 0528125

(51) Int. Cl.
*G09F 13/08* (2006.01)

(52) U.S. Cl.
USPC ..... 362/97.4; 362/634

(58) Field of Classification Search
USPC ..... 362/97.1–97.4, 632–634, 614
See application file for complete search history.

(56) References Cited

U.S. PATENT DOCUMENTS

| | | | | |
|---|---|---|---|---|
| 2005/0073858 | A1* | 4/2005 | Kim et al. | 362/561 |
| 2007/0035942 | A1* | 2/2007 | Chang | 362/97 |
| 2007/0081322 | A1* | 4/2007 | Choi et al. | 362/97 |
| 2007/0139911 | A1* | 6/2007 | Yang et al. | 362/97 |

* cited by examiner

*Primary Examiner* — Julie Bannan
(74) *Attorney, Agent, or Firm* — Ladas & Parry LLP

(57) ABSTRACT

The disclosed technology provides a backlight lamp guide, a back cover for a backlight, and a backlight. The backlight lamp guide, the back cover and the backlight comprise a lateral positioning mechanism. The lateral positioning mechanism prevents the backlight lamp guide and the back cover from moving with respect to each other in a direction parallel to the back cover.

10 Claims, 4 Drawing Sheets

BACKLIGHT LAMP GUIDE, BACK COVER AND BACKLIGHT

BACKGROUND

Embodiments of the disclosed technology relate to a backlight lamp guide, a back cover, and a backlight having the backlight lamp guide and the back cover.

In a backlight of a direct-illumination type for a liquid crystal display device, as shown in FIG. 1 and FIG. 2, a lamp guide 1 is connected to a back cover 2 (a backlight can comprise a plurality of groups of lamp guides 1, while only one group is illustrated in the figures). The lamp guide 1 comprises a lamp holder 11 for supporting a lamp (for example, a cold cathode fluorescent lamp) 3 and a strut 12 for supporting a diffusion plate 4. The bottoms of both the lamp holder 11 and the strut 12 are connected by a connecting portion 19. Circular bosses (an upper stop) 13 are provided at a lower side of the lamp holder 11 and the strut 12, and a lower surface of the circular boss 13 is connected with an engaging mechanism (a lower stop) 14. The engaging mechanism 14 passes through a hole 21 in the back cover 2. Engaging paws of the engaging mechanism 14 retract as passing through the hole 21, and expand after passing through the hole 21, thus making the back cover 2 stuck between the lower surface of the circular boss 13 and an upper surface of the engaging mechanism 14, and positioning the lamp guide 1 with respect to the back cover 2.

SUMMARY

Embodiments of the disclosed technology is to provide a backlight lamp guide, a back cover and a backlight which are improved and capable of prevent the lamp guide and the back cover from moving with respect to each other in a direction parallel to the back cover.

According to an embodiment of the disclosed technology, a backlight lamp guide is provided, which is connected to a back cover in a backlight and comprises a lamp holder for supporting a lamp, wherein, the backlight lamp guide further comprises a lateral positioning mechanism adapted to connect with the back cover and for preventing the backlight lamp guide from moving with respect to the back cover in a direction parallel to the back cover.

The lateral positioning mechanism of the backlight lamp guide comprises at least one protruding portion adapted to be held within a concaved portion in the back cover, and the concaved portion is selected from a group consisted of a hole and a groove.

The protruding portion can be cylindrical with a positioning block protruding from a sidewall thereof for engaging with a notch in an inner wall of the concaved portion in the back cover.

The backlight lamp guide can further comprise one strut in the middle portion thereof. The protruding portion can be arranged under at least one of the strut and the lamp holer.

The backlight lamp guide can further comprise an upper stop and a lower stop for holding the back cover therebetween in a direction perpendicular to the back cover; the protruding portion is arranged on a lower surface of the upper stop; and the lower stop is connected to a lower surface of the protruding portion.

The lateral positioning mechanism of the backlight lamp guide can comprise at least one concaved portion adapted to hold a protruding portion on the back cover. The concaved portion is selected from a group consisted of a hole and a groove.

According to another embodiment of the disclosed technology, a back cover for a backlight is provided, which is adapted to connect with a backlight lamp guide and comprises a lateral positioning mechanism adapted to connect with the backlight lamp guide and for preventing the back cover from moving with respect to a backlight lamp guide in a direction parallel to the back cover.

The lateral positioning mechanism of the back cover can comprise at least one concaved portion for accommodating a protruding portion on the backlight lamp guide, sizes of the concaved portion and the protruding portion in the direction parallel to the back cover match with each other, and the concaved portion is selected from a group consisted of a hole and a groove.

The concaved portion can be in a circular shape, and an inner wall of the concaved portion can comprise a notch therein for accommodating a positioning block on the circumference of the protruding portion of the backlight lamp guide.

The lateral positioning mechanism of the back cover can comprise at least one protruding portion for extending into a concaved portion in the backlight lamp guide, sizes of the concaved portion and the protruding portion in the direction parallel to the back cover match with each other, and the concaved portion is selected from a group consisted of a hole and a groove.

According to further another embodiment of the disclosed technology, a backlight is provided, which comprises a back cover and a lamp guide connected to the back cover, wherein, the backlight further comprises a lateral positioning mechanism for preventing the lamp guide from moving with respect to the back cover in a direction parallel to the back cover.

The lateral positioning mechanism of the backlight comprises at least one protruding portion formed on one of the lamp guide and the back cover, and at least one concaved portion formed in the other one of the lamp guide and the back cover for accommodating the protruding portion, sizes of the protruding portion and the concaved portion in the direction parallel to the back cover match with each other, and the concaved portion is selected from a group consisted of a hole and a groove.

As the backlight lamp guide, the back cover and the backlight according to the embodiment of the disclosed technology comprise a lateral positioning mechanism, the lam guide and the back cover can be prevented from moving with respect to each other in the direction parallel to the back cover, thus preventing a lamp from shaking.

Further scope of applicability of the disclosed technology will become apparent from the detailed description given hereinafter. However, it should be understood that the detailed description and specific examples, while indicating preferred embodiments of the disclosed technology, are given by way of illustration only, since various changes and modifications within the spirit and scope of the disclosed technology will become apparent to those skilled in the art from the following detailed description.

BRIEF DESCRIPTION OF THE DRAWINGS

The disclosed technology will become more fully understood from the detailed description given hereinafter and the accompanying drawings which are given by way of illustration only, and thus are not limitative of the disclosed technology and wherein.

DETAILED DESCRIPTION

Next, technical solutions of embodiments of the disclosed technology will be described in a clear and complete way with reference to the accompanying drawings for the embodiments of the disclosed technology. Apparently, the described embodiments are only part of the embodiments of the disclosed technology, not all the embodiments. All of the other embodiments obtained by the skilled in the art based on the embodiments of the present disclosure without creative effort, fall in the protection scope of the disclosed technology.

Figure 1:
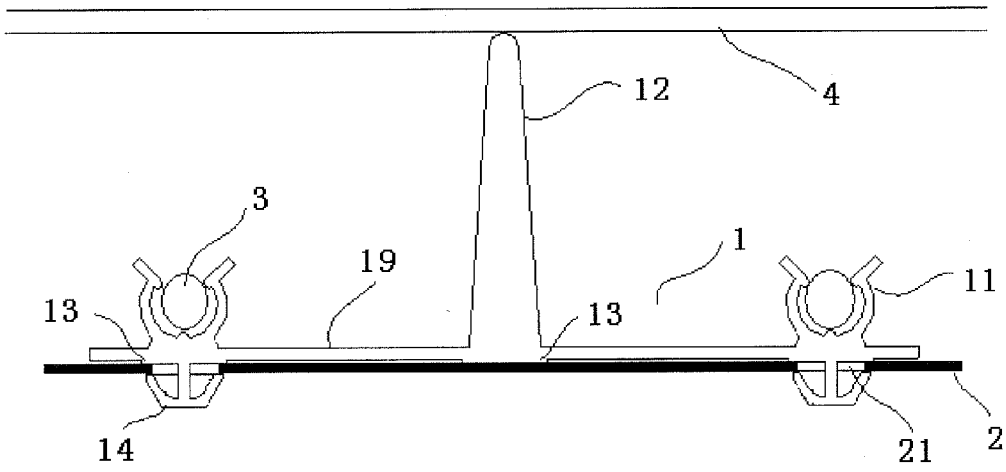
FIG. 1 is a schematic sectional view of an existing backlight.
Figure 2:
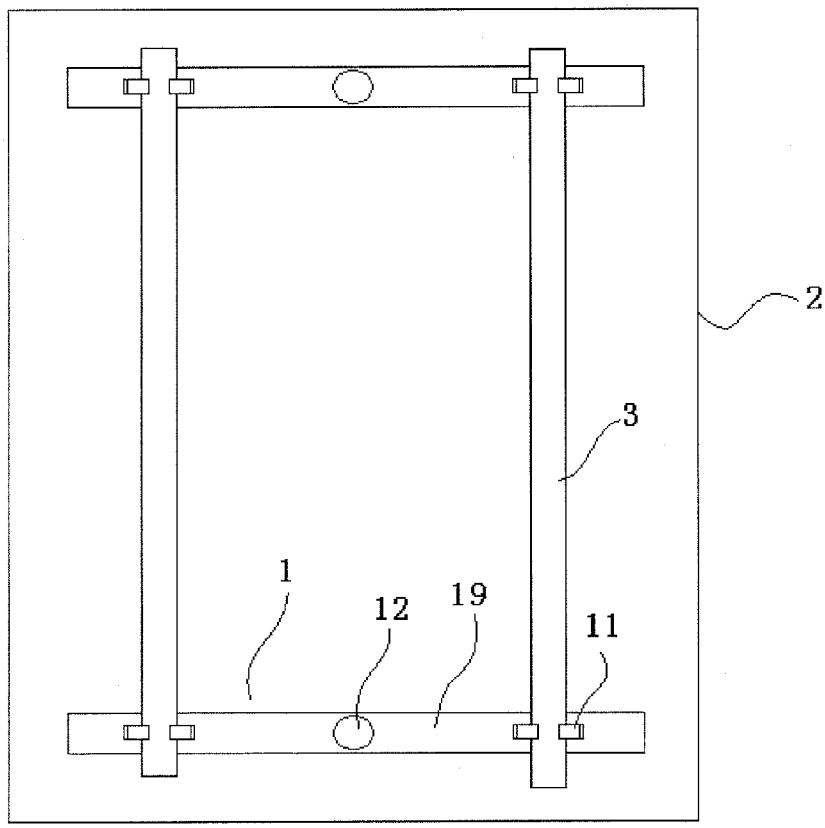
FIG. 2 is a schematic top view of the existing backlight (a diffusion plate is not shown)

The inventors have found that the technology shown in FIGS. 1 and 2 has the following problems. The backlight lamp guide 1 and the back cover 2 are connected to each other with the circular boss 13 and the engaging mechanism 14, and although this structure can prevent the displacement between the circular boss 13 and the engaging mechanism 14 in the vertical direction, it cannot avoid the displacement between the circular boss 13 and the engaging mechanism 14 along the horizontal direction, resulting in shaking of lamps 3 in transferring.

According to an embodiment of the disclosed technology, a backlight lamp guide is provided, which comprises a lamp holder for supporting a lamp, and a lateral positioning mechanism for preventing the backlight lamp guide from moving with respect to a back cover in a direction parallel to the back cover.

As the backlight lamp guide of the embodiment of the disclosed technology comprises a lateral positioning mechanism, the backlight lamp guide can be prevented from moving with respect to a back cover in a direction parallel to the back cover, thereby preventing a lamp from shaking, and as a result, improving display quality, as well as reducing damages to a lamp, etc.

First Embodiment

Figure 3:
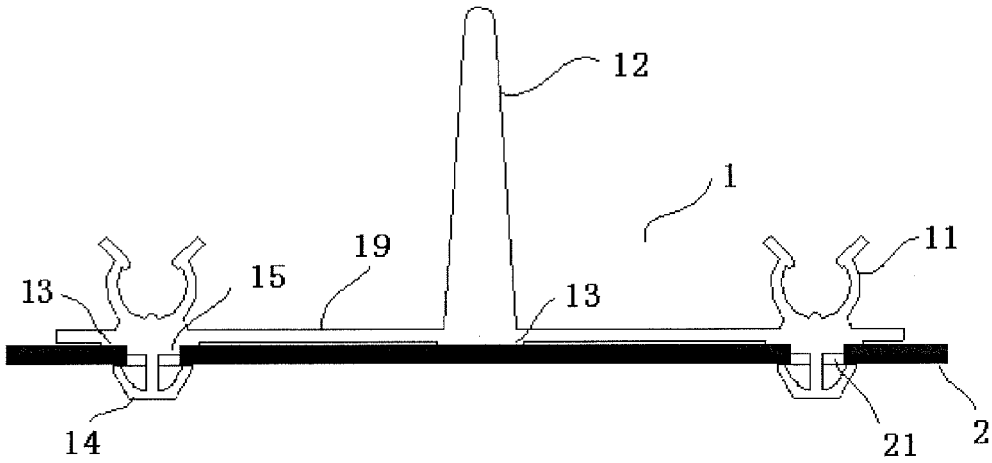
FIG. 3 is a schematic sectional view of a backlight lamp guide and a matching back cover according to an embodiment of the disclosed technology.
Figure 4:
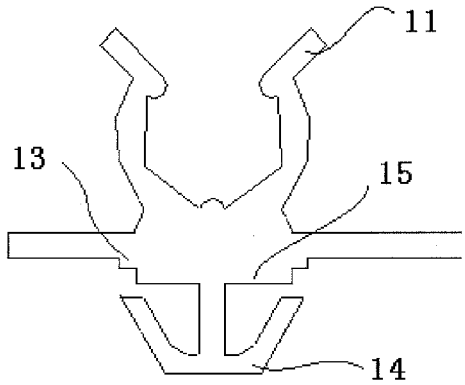
FIG. 4 is a schematic partial sectional view of a lamp holder of a backlight lamp guide and its periphery portion according to an embodiment of the disclosed technology.

As shown in FIG. 3 and FIG. 4, the present embodiment of the disclosed technology provides a backlight lamp guide 1, which comprises a lamp holder 11 at two ends and a strut 12 in the middle portion. The lamp holder 11 and the strut 12 are connected by a connecting portion 19. At a lower side of each of the lamp holder 11 and the strut 12, is provided a boss (an upper stop) 13. The bosses 13 can be in a cylindrical shape. On a lower surface of the boss 13 under each of the two lamp holders 11, is further provided a protruding portion (lateral positioning mechanism) 15, which is in a cylindrical shape and is used for extending into a circular hole 21 in a back cover 2. Size of the protruding portion 15 in a direction parallel to the back cover 2 matches with size of the hole 21 in the same direction. For example, radial size of an outer wall of the protruding portion 15 is substantially the same as radial size of an inner wall of the hole 21. Thus the backlight lamp guide 1 can be prevented from moving with respect to the back cover 2 in a direction parallel to the back cover 2. Two protruding portions 15 are provided in the present embodiment, because one cylindrical protruding portion 15 may rotate in the circular hole 21, whereas two protruding portions 15 can prevent rotation. The lower surfaces of the protruding portions 15 are further connected to engaging mechanisms (lower stops) 14 which abut on an lower surface of the back cover 2. In order not to affect the contact of the engaging mechanisms 14 with the back cover 2, it is preferred that the height of the protruding portions 15 do not exceed the thickness of the back cover 2. For example, the height can be a half of the thickness of the back cover 2. The bosses 13 and the engaging mechanisms 14 are used for sandwiching the back cover 2 therebetween, thus preventing the backlight lamp guide 1 from moving with respect to the back cover 2 in a direction perpendicular to the back cover 2.

In the embodiment, the boss 13 is provided and thus the connecting portion 19 is made not to contact with the back cover 2 directly, so that it is possible to reduce contact area between the backlight lamp guide 1 and the back cover 2, as well as damages of the backlight lamp guide 1 to surface coatings of the back cover 2. However, the disclosed technology can also be achieved without the boss 13. The reason for providing the bosses 13 at a lower sides of the lamp holder 11 and the strut 12 is that, these locations are directly under pressure from the lamp and the diffusion plate, and the force that the connecting portion 19 bears can be reduced with the bosses 13 provided here. Nevertheless, the disclosed technology can also be achieved with the bosses 13 provided on other locations. The reason for providing the protruding portions 15 on the lower surfaces of the bosses 13 is that, the hole 21 of the back cover 2 can thus simultaneously be used to accommodate the protruding portions 15 and let the engaging mechanism 14 pass through, and therefore there is no need to provide dedicate holes 21 for the protruding portions 15. For the backlight lamp guide 1 of the present embodiment, the matching back cover 2 can be an existing conventional back cover 2.

Second Embodiment

Figure 5:
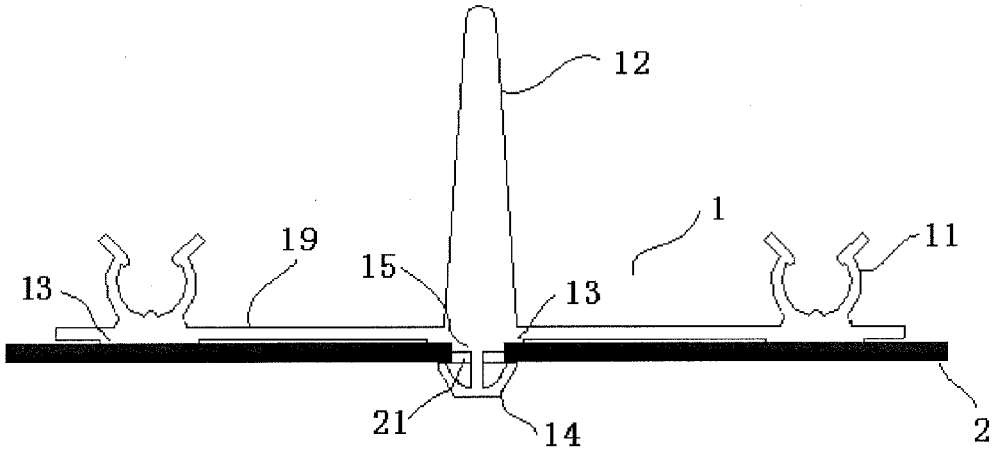
FIG. 5 is a schematic sectional view of an backlight lamp guide and a matching back cover according to another embodiment of the disclosed technology.
Figure 6:
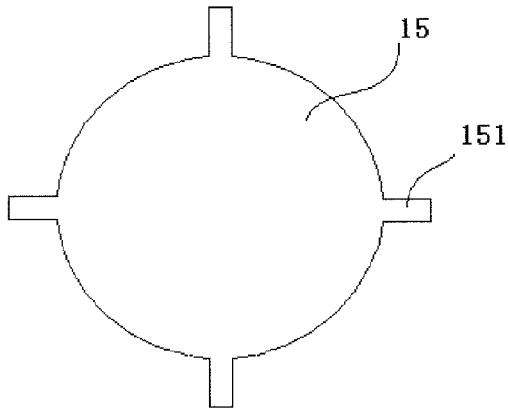
FIG. 6 is a schematic cross-sectional view of a protruding portion of an backlight lamp guide according to another embodiment of the disclosed technology.

As shown in FIG. 5, the present embodiment of the disclosed technology provides a backlight lamp guide 1, which has a structure similar to that of the backlight lamp guide 1 of the first embodiment. The difference lies in that, in the present embodiment, at the lower side of the lamp holder 11 there is only bosses 13 but no protruding portions or engaging mechanisms, whereas at the lower side of the strut 12 are provided a protruding portion 15 and an engaging mechanism 14 on the boss 13. As shown in FIG. 6, the protruding portion 15 is in a cylindrical shape with positioning blocks 151 protruding from an outer wall thereof, and matches with a hole 21 in the back cover 2. The number of the positioning block 151 is at least one, but a plurality of (for example four) positioning blocks 151 are preferable. The positioning blocks 151 can be engaged into notches in an inner wall of the hole 21, thus preventing the protruding portion 15 from rotating in the hole 21. Of course, the cross section of the protruding portion 15 can be in other non-circular shapes, such as triangle, rectangle, ellipse, etc. As the protruding portions 15 of the backlight lamp guide 1 of the present embodiment has a cross section in a non-circular shape, it will not rotate in the hole 21. Therefore only one protruding portion 15 and one engaging mechanism 14 are required in the backlight lamp guide 1. Accordingly, the number of the protruding portions 15 and the engaging mechanism 14 is small, and the whole structure is simple and easy to be manufactured. At the same time, only one hole 21 is required to be formed in the back cover 2 that matches with the backlight lamp guide 1. Accordingly, the required punching is lessened, and manufacturing is made easier. Moreover, as the protruding portion 15 is arranged at the lower side of the strut, that is, it is arranged in the middle portion of the backlight lamp guide 1, the backlight lamp guide 1 bears uniform forces and is not easy to be damaged.

Third Embodiment

Figure 7:
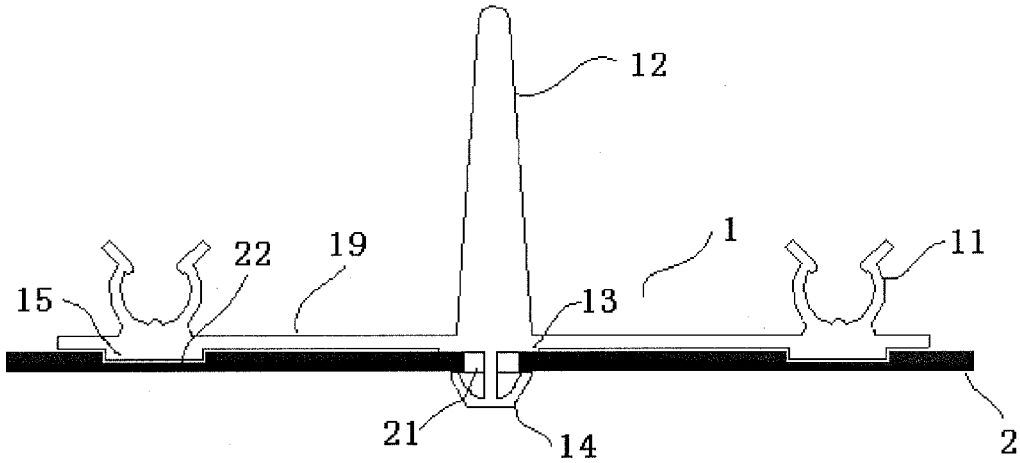
FIG. 7 is a schematic sectional view of an backlight lamp guide and a matching back cover according to another embodiment of the disclosed technology.

As shown in FIG. 7, the present embodiment of the disclosed technology provides a backlight lamp guide 1, which has a structure similar to that of the backlight lamp guide 1 of the first embodiment. The difference lies in that, in the present embodiment, at the lower side of the strut 2 are provided a boss 13 and an engaging mechanism 14 but no protruding portion, whereas at the lower sides of the lamp holders 11 are directly provided protruding portions 15 (without a boss) for extending into grooves 22 in the back cover 2. The protruding portions 15 can be in any shape matching with the shape of the grooves 22 (for the purpose of clarity, a relatively large gap is illustrated between the protruding portion 15 and the groove 22 in the figure, while in fact there should be no gap or the gap should be very small). In the present embodiment, the height of the protruding portions 15 and the depth of the grooves 22 should also match with each other, so as to ensure the lower surface of the boss 13 can contact with the upper surface of the back cover 2.

Fourth Embodiment

Figure 8:
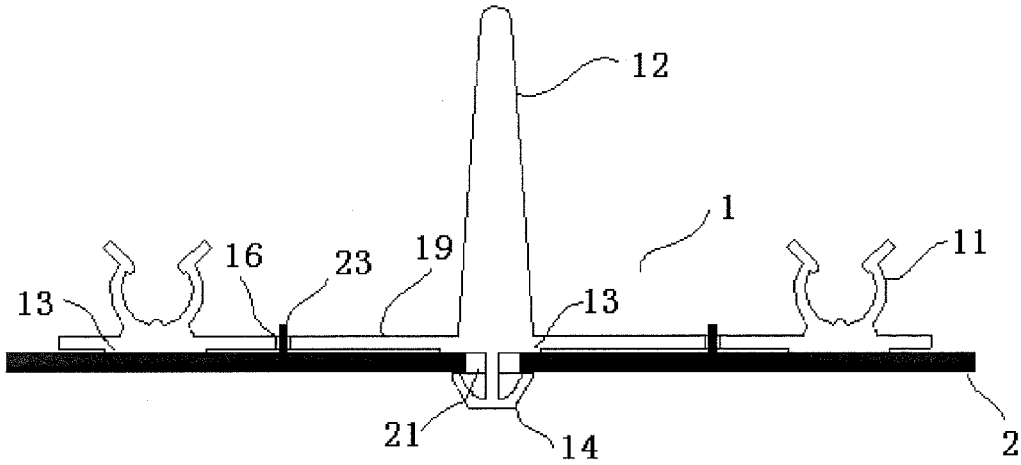
FIG. 8 is a schematic sectional view of an backlight lamp guide and a matching back cover according to another embodiment of the disclosed technology.
Figure 9:
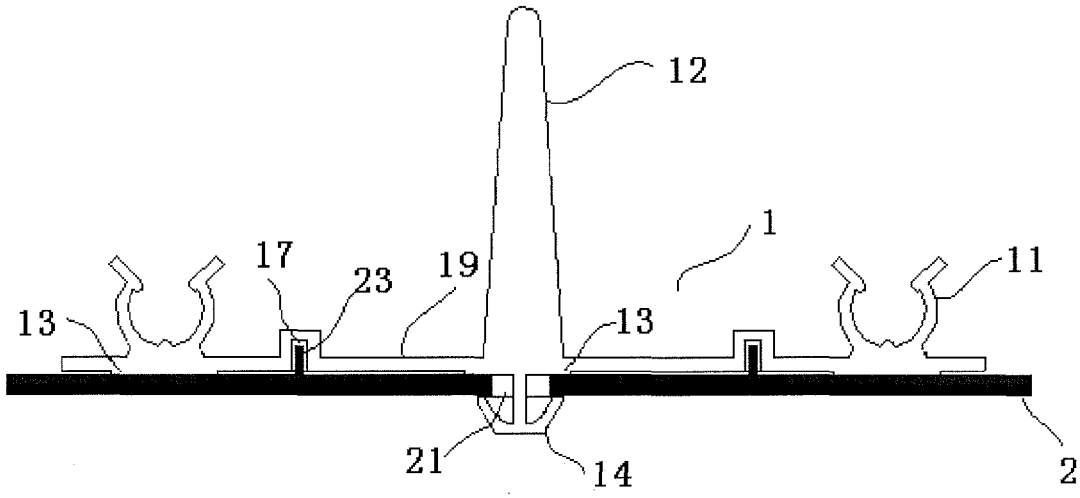
FIG. 9 is a schematic sectional view of an backlight lamp guide and a matching back cover according to another embodiment of the disclosed technology.

As shown in FIG. 8 and FIG. 9, the present embodiment of the disclosed technology provides a backlight lamp guide 1, which has a structure similar to that of the backlight lamp guide 1 of the third embodiment. The difference lies in that, in the present embodiment, at the lower side of the lamp holder 11 is provided a boss 13 but no protruding portion, and the connecting portion 19 comprises two holes 16 or grooves 17 (lateral positioning mechanisms) therein, which are used for accommodating protruding portions 23 provided on the back cover 2 and can be in any shape matching with the shape of the protruding portions 23. Size of the holes or grooves 17 in a direction parallel to the back cover 2 matches with size of the protruding portions 23 in the same direction. Although a relatively large gap is illustrated between the hole 16 or groove 17 and the protruding portion 23 in the figures for the purpose of clarity, in fact there should be no gap or the gap should be very small.

Apparently, various modifications can be made to the backlight lamp guide 1 of each of the above-described embodiments. For example, number, arrangements, specific shapes, etc. of the bosses 13, the strut 12, and the lamp holders 11 of the backlight lamp guide 1 can all be varied; number, arrangements, and specific shapes of the protruding portions 15 can be varied; number, arrangements, and specific shapes of the holes 16 or grooves 17 can be varied; and the backlight lamp guide 1 can simultaneously comprises a protruding portion 15, a hole 16, and a groove 17 therein.

The embodiments of the disclosed technology provide a back cover which comprises a lateral positioning mechanism for preventing the back cover from moving with respect to a backlight lamp guide in a direction parallel to the back cover. As in embodiments of the disclosed technology the back cover comprises a lateral positioning mechanism, the back cover can be prevented from moving in a direction parallel to itself with respect to the backlight lamp guide, thus preventing a lamp from shaking.

Fifth Embodiment

Figure 10:
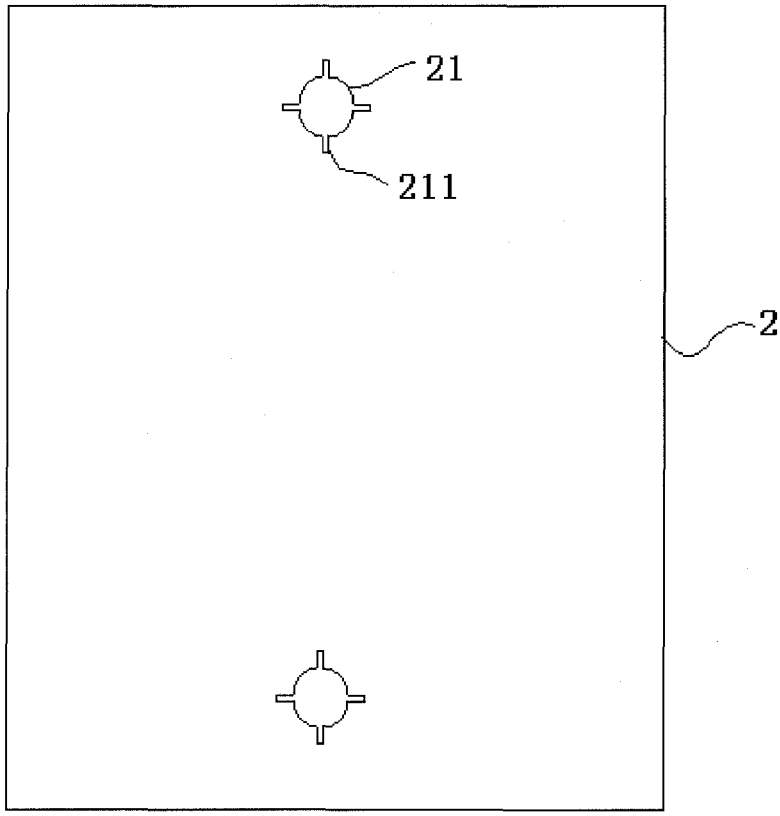
FIG. 10 is a schematic top view of a back cover according to an embodiment of the disclosed technology.

The present embodiment of the disclosed technology provides a back cover 2, which comprises a hole 21 (lateral positioning mechanism) for accommodating a protruding portion 15 of the backlight lamp guide 1 as shown in the second embodiment, as shown in FIG. 5 and FIG. 10. The hole 21 matches with a protruding portion 15 of the backlight lamp guide 1 shown in the second embodiment, and is in a circular shape with notches 211 formed on its circumference for accommodating the positioning blocks 151 on the circumference of the protruding portion 15. Of course, the hole 21 can also be in other non-circular shapes, such as triangle, rectangle, ellipse, etc.

As the positioning of the backlight lamp guide 1 is achieved by only one hole 21 in the back cover 2 in the present embodiment, the structure is simple and the cost for manufacturing is low.

Sixth Embodiment

The present embodiment of the disclosed technology provides a back cover 2, which comprises grooves (a lateral positioning mechanism) 22 for accommodating the protruding portions 15 of the backlight lamp guide 1 of the third embodiment, as shown in FIG. 7. The grooves 22 can be in any shapes matching with the shape of the protruding portions 15. The back cover 2 also comprises a hole 21 for the engaging mechanism 14 to pass therethrough.

Seventh Embodiment

The present embodiment of the disclosed technology provides a back cover 2, which comprises protruding portions (lateral positioning mechanisms) 23 for extending into the holes 16 or grooves 17 of the backlight lamp guide 1 of the fourth embodiment, as shown in FIG. 8 and FIG. 9. The protruding portions 23 can be in any shapes matching with the shape of the holes 16 or grooves 17. The back cover 2 also comprises a hole 21 formed therein for the engaging mechanism 14 to pass therethrough.

Apparently, various modifications can be made to the back cover 2 of each of the above-described embodiments. For example, number, arrangements, specific shapes, etc. of the protruding portions 23, the grooves 22, and the holes 21 of the back cover 2 can be varied.

Although the disclosed technology is described above with examples of the lamp guide and back cover, those skilled in the art will understand the backlight according to embodiments of the disclosed technology comprises the lamp guide and the back cover. Therefore, description of the embodiments of the backlight is omitted here.

The disclosed technology being thus described, it will be obvious that the same may be varied in many ways. Such variations are not to be regarded as a departure from the spirit and scope of the disclosed technology, and all such modifications as would be obvious to those skilled in the art are intended to be included within the scope of the following claims.

What is claimed is:

1. A backlight lamp guide connected to a back cover in a backlight, comprising:

a lamp holder for supporting a lamp, and a lateral positioning mechanism adapted to connect with the back cover for preventing the backlight lamp guide from moving with respect to the back cover in a direction parallel to the back cover, wherein the lateral positioning mechanism comprises at least one protruding portion adapted to be held within a concaved portion in the back cover, and the concaved portion is selected from a group consisted of a hole and a groove, and the lateral positioning mechanism comprises a cylindrical protruding portion, and a side wall of the cylindrical protruding portion is formed with a positioning block protruding therefrom, which is adapted to engage with a notch in an inner wall of the concaved portion in the back cover.

2. The backlight lamp guide according to claim 1, wherein the lateral positioning mechanism comprises at least two protruding portions.

3. The backlight lamp guide according to claim 2, wherein the lateral positioning mechanism comprises two cylindrical protruding portions.

4. The backlight lamp guide according to claim 1, wherein the backlight lamp guide further comprises one strut in the middle portion thereof, and the protruding portion is arranged under the strut.

5. The backlight lamp guide according to claim 1, wherein the protruding portion is arranged under the lamp holder.

6. The backlight lamp guide according to claim 1, further comprising an upper stop and a lower stop for holding the back cover therebetween in a direction perpendicular to the back cover, wherein the protruding portion is arranged on a lower surface of the upper stop, and the lower stop is connected to a lower surface of the protruding portion.

7. A backlight comprising:

a back cover, and a lamp guide connected to the back cover, wherein the backlight comprises a lateral positioning mechanism, which is adapted to connect with the back cover and to prevent the lamp guide from moving with respect to the back cover in a direction parallel to the back cover, wherein the lateral positioning mechanism comprises at least one protruding portion formed on one of the lamp guide and the back cover, and at least one concaved portion formed in the other one of the lamp guide and the back cover for holding the protruding portion, and the concaved portion is selected from a group consisted of a hole and a groove, and wherein the lamp guide comprises the protruding portion, and the back cover comprises the concaved portion, the protruding portion is in a cylinder shape with a positioning block protruding from a side wall thereof for engaging with a notch in an inner wall of the concaved portion in the back cover.

8. The backlight according to claim 7, wherein the lamp guide comprises the protruding portion, and the back cover comprises the concaved portion, and the lamp guide further comprises a strut arranged in a middle portion, and the protruding portion is arranged under the strut.

9. The backlight according to claim 7, wherein the lamp guide comprises the protruding portion, and the back cover comprises the concaved portion, and the protruding portion is arranged under the lamp holder.

10. The backlight according to claim 7, wherein the lamp guide comprises the protruding portion and the back cover comprises the concaved portion, and the protruding portion is connected to an upper stop at an upper side thereof and to a lower stop at a lower side thereof, and the upper stop and the lower stop hold the back cover therebetween in a direction perpendicular to the back cover.

* * * * *